US009286864B2

(12) United States Patent
Young et al.

(10) Patent No.: US 9,286,864 B2
(45) Date of Patent: Mar. 15, 2016

(54) MOUNT FOR TREMOLO ARM

(71) Applicants: David Young, San Diego, CA (US); Robert Scott Fisher, Encinitas, CA (US)

(72) Inventors: David Young, San Diego, CA (US); Robert Scott Fisher, Encinitas, CA (US)

( * ) Notice: Subject to any disclaimer, the term of this patent is extended or adjusted under 35 U.S.C. 154(b) by 0 days.

(21) Appl. No.: 14/320,302

(22) Filed: Jun. 30, 2014

(65) Prior Publication Data

US 2015/0027292 A1 Jan. 29, 2015

Related U.S. Application Data

(60) Provisional application No. 61/857,394, filed on Jul. 23, 2013, provisional application No. 61/899,537, filed on Nov. 4, 2013.

(51) Int. Cl.

*G10D 3/00* (2006.01)
*G10D 3/14* (2006.01)
*G10D 1/08* (2006.01)

(52) U.S. Cl.

CPC ..... *G10D 3/146* (2013.01); *G10D 1/085* (2013.01); *G10D 3/00* (2013.01); *G10D 3/14* (2013.01); *G10D 3/143* (2013.01)

(58) Field of Classification Search

CPC ..... G10D 3/146; G10D 3/14; G10D 3/00
USPC ..... 84/313
See application file for complete search history.

(56) References Cited

U.S. PATENT DOCUMENTS

| | | | | | |
|---|---|---|---|---|---|
| 3,162,083 | A * | 12/1964 | Webster | G10D 3/146 | 84/313 |
| 4,457,201 | A * | 7/1984 | Storey | G10D 3/146 | 84/267 |
| 4,632,004 | A * | 12/1986 | Steinberger | G10D 3/146 | 84/304 |
| 4,638,711 | A * | 1/1987 | Stroh | G10D 3/12 | 84/298 |
| 4,681,011 | A * | 7/1987 | Hoshino | G10D 3/146 | 84/267 |
| D356,328 | S * | 3/1995 | Pozzobon | D17/21 | |
| 5,419,227 | A * | 5/1995 | Lavineway | G10D 3/146 | 84/313 |
| 5,429,028 | A * | 7/1995 | Fisher, IV | G10D 3/146 | 84/313 |
| 5,808,216 | A * | 9/1998 | Fisher, IV | G10D 3/146 | 84/313 |
| 5,864,074 | A * | 1/1999 | Hill | G10D 3/146 | 84/313 |
| 5,939,653 | A * | 8/1999 | Chang | G10D 1/085 | 84/298 |
| 6,034,311 | A * | 3/2000 | Fisher, IV | G10D 3/146 | 84/307 |
| 6,118,057 | A * | 9/2000 | Chang | G10D 3/12 | 84/298 |
| 7,045,693 | B2 * | 5/2006 | Rose | G10D 3/04 | 84/298 |
| 7,189,908 | B2 * | 3/2007 | Lavineway | G10D 3/146 | 84/313 |
| 7,247,780 | B2 * | 7/2007 | Sanders | G10D 3/146 | 84/313 |
| 7,521,616 | B2 * | 4/2009 | Kahler | G10D 3/146 | 84/313 |
| 8,536,430 | B2 * | 9/2013 | McCabe et al. | G10D 3/14 | 84/312 R |
| 8,766,070 | B2 * | 7/2014 | Zumsteg | G10D 3/146 | 84/313 |
| 2004/0074373 | A1 * | 4/2004 | Goto | C23C 18/36 | 84/452 R |
| 2006/0219086 | A1 * | 10/2006 | Sanders | G10D 3/146 | 84/455 |
| 2012/0137851 | A1 * | 6/2012 | van Ekstrom | G10D 3/146 | 84/313 |
| 2012/0152082 | A1 * | 6/2012 | Parillo | G10D 3/146 | 84/313 |
| 2013/0239771 | A1 * | 9/2013 | Kernick | G10D 3/146 | 84/313 |
| 2014/0202307 | A1 * | 7/2014 | Rose | G10D 3/146 | 84/313 |
| 2014/0202308 | A1 * | 7/2014 | Maslarov | G10D 3/146 | 84/313 |
| 2015/0027292 | A1 * | 1/2015 | Young | G10D 1/085 | 84/313 |
| 2015/0027293 | A1 * | 1/2015 | Young | G10D 1/085 | 84/313 |

* cited by examiner

FOREIGN PATENT DOCUMENTS

GB 2472577 A * 2/2011

*Primary Examiner* — David Warren
*Assistant Examiner* — Christina Schreiber
(74) *Attorney, Agent, or Firm* — Donn K. Harms

(57) ABSTRACT

A mount for the improved engagement of a tremolo arm with a pivoting bridge of a stringed instrument is provided. The mount features a body having a first side adapted for an engagement with a surface of the bridge. The arm is engageable to conventional bridges or may be employed with an arm mount having a centered attachment point and can include a biasing washer to maintain a position of the tremolo arm relative to the mount. A tremolo arm mount is provided at a central portion of the body relative to the width of a pathway followed by the strings projecting from the bridge toward the neck of the stringed instrument.

10 Claims, 4 Drawing Sheets

MOUNT FOR TREMOLO ARM

BACKGROUND OF THE INVENTION

This application claims priority to U.S. Provisional Patent Application Ser. No. 61/857,394 filed on Jul. 23, 2013 U.S. Provisional Patent Application 61/899,537 filed on Nov. 4, 2013, both of which are incorporated herein in their respective entirety by this reference thereto.

1. Field of the Invention

The present device relates to stringed instruments. More particularly it relates to a mount for a tremolo arm providing a centered positioning of the engagement point for the distal end of a Tremolo arm employed for pivoting the bridge in its engagement with the guitar body.

2. Prior Art

In music, tremolo is a trembling vibrato effect imparted to the played music heard by the listener. When playing a guitar, a Tremolo effect is produced by inducing a variation in the amplitude of the produced note from the strings.

A variety of mechanical tremolo or vibrato systems for guitars have been developed and employed by musicians since the 1930s and are employed to add vibrato to the sound of the music, by imparting a change to the tension of the strings. Typically the mechanical action to impart this change in tension is communicated as a pivoting of the bridge or tailpiece of an electric guitar in its engagement to the body. The implement of choice for most guitarists to impart this tensional variation to elicit the vibrato effect to their music, is a controlling lever, often referred to as a whammy bar, a vibrato armor bar, or a tremolo armor bar.

During guitar playing, by gripping the lever engaged with the bridge connected to the strings, the musician may communicate an oscillating motion to the bar, toward and away from the body of the guitar. Conventionally this motion pivots the bridge engaged to the strings opposite the guitar neck, and enables the player to quickly vary the tension and sometimes the length of the strings temporarily.

On an electric guitar this imparted movement of the bridge to vary string length and tension, also moves the strings into differing positions within the magnetic field proximate to the electronic string pickups. Both of these temporary and varying physical changes to the strings, cause a change the pitch of the music produced, by the stringed instrument or guitar to create a vibrato, or pitch-bend effect to the sound.

Since the regular appearance of conventional mechanical vibrato systems generally using gripped-arms to change string tension in the 1950s, such devices have been regularly employed by many guitarists. In the 1960s and 1970s, vibrato or tremolo arms connected to the mount for the guitar strings or bridge, were widely used for significantly more dramatic effects by rock and roll guitarists. Since then the pitch-bending effects produced by movement of the tremolo arm, whether subtle inflections or exaggerated effects, have become an important part of many styles of electric guitar, and a welcome addition to virtually every electric guitar.

Typical prior art is taught by U.S. Pat. No. 274,114 by Fender, an example thereof shown in the drawings herein as prior art in the drawings. In prior art of Fender and as taught in most other electric guitar art, a stout handle is engaged to a pivotally engaged bridge for the strings. The handle in the prior art may be rotated out of the way from strumming when not in use.

In use in conventional devices like that of Fender, the bar is rotated to a comfortable position for gripping in the hand of the user. Once gripped, the user oscillates movement of the bar by pushing it toward the guitar body, and immediately pulling it back again. This movement produces a tremolo effect in the music through the communicated force in the arm, pivoting the bridge in its engagement to the guitar which causes variable changes to both string length and string position over the electronic pickups.

However, systems typical of that taught in Fender have significant shortcomings. Most significantly, in the majority of Tremolo arm engagements to guitar string bridges, the engagement point for the Tremolo bar in most instances is at an engagement point on one edge of the bridge adjacent one of the row of strings. Because this engagement of the arm is significantly off center from the center of the pathway of the strings extending from their engagement to the bridge, movement of the bar the user of the arm, to induce a pivoting of the bridge and the resulting vibrato effect, is communicated to one edge of the bridge adjacent an outside string. This and most other modes of such engagement are significantly off-center from the central area of the bridge where the strings engage, and on one end of the pivoting axis of the bridge.

The significant force communicated to the elongated handle to pivot the bridge around its axis to change spring length and tension, is thus communicated to one edge of the bridge off center. This force so delivered off center causes an uneven pivot of the bridge, misaligned with the axis thereof, such that the strings closest to the attachment of the arm to the bridge are shortened more and de tensioned more than the strings engaged to the bridge which are located further away. This is caused by an angled or rocking pivot of the bridge out of alignment with its axis in a resting state.

As such, there exists an unmet need for an improved engagement of the tremolo bar to a stringed instrument bridge, such as a guitar, which provides for a more even distribution of the communicated force. Such a device should communicate the force to the bridge from the Tremolo arm, in a fashion which substantially maintains the bridge aligned with its axis in a resting state, when force is imparted to pivot it. Such a device thus would in communicating even force across the pivoting bridge, cause a substantially equal string tension and length change to all strings engaged with the bridge. Finally, such a device should be adapted to engage with and function as a Tremolo mount, to most bridge designs by provision of a cooperating edge of the mount, and means for engagement with the bridge.

The forgoing examples of related art and limitations related therewith are intended to be illustrative and not exclusive, and they do not imply any limitations on the bridge engagement component for a Tremolo bar, and the method described and claimed herein. Various additional limitations of the related art will become apparent to those skilled in the art upon a reading and understanding of the specification below and the accompanying drawings.

OBJECTS OF THE INVENTION

It is an object of the invention to provide a significantly improved means for engagement of a Tremolo bar to a pivoting bridge on a guitar or stringed instrument.

It is an additional object of the invention to provide such a tremolo bar engagement which is constructed to communicate force from the user employing it, substantially equally to the bridge to allow pivoting along its axis without substantial variance therefrom.

It is a further object of this invention to provide such a device and method which equally affects all the strings engaged to the bridge by imparting a smooth on-axis pivot to the bridge, thereby avoiding out of tune music.

These and other objects, features, and advantages of the present musical invention, as well as the advantages thereof over existing prior art, which will become apparent from the description to follow, are accomplished by the novel improvements described in this specification and hereinafter of this guitar Tremolo arm engagement for a bridge as described in the following detailed description which fully discloses the invention, which however in no manner should be considered as placing any limitations thereon.

SUMMARY OF THE INVENTION

In accordance with the purposes of the present invention, as embodied and broadly described herein, the present invention provides an apparatus adapted for operative engagement with a movable or pivoting bridge which is engaged to the guitar strings and the body of the guitar. The device features a body having a first side configured for operative engagement to a guitar bridge without touching the strings or string mounts engaged with the bridge or a bridge plate. The body portion of the device, engaged with the bridge in an as-used position, positions an engagement point for the attachment end of a Tremolo bar, in a central area of the body and centrally located in line or along the width of the pathway of the plurality of strings which engaged the bridge.

The body is configured on the first side, with recesses and or cavities sized and configured to be complimentary to projecting string mounts from the bridge and provide a gap between the body and any string mounts projecting from the bridge or strings engaged to the bridge.

In one mode preferred mode the first side is configured with recesses adapted to surround and slidably engaged upon a projecting ledge extending from the baseplate of the bridge. In other modes, the body portion is adapted to engage the first side to the bridge or bridge plate, using connecting fasteners on each component such as threaded screws engaging threaded apertures in the base plate of the bridge.

In all modes of the device, a central portion of the body of the device is elevated sufficiently to maintain a distance from the underlying strings or string mounts. Additionally in all modes, a point for engagement of the engagement end of a tremolo bar, is centrally positioned between two opposing connections adjacent side edges of the body, and therefor centrally located within or adjacent the width of a pathway of strings extending from the bridge.

By providing a centrally located engagement point to attach the Tremolo arm, when the arm is employed through movement by the user to pivot the bridge, the force is delivered to the bridge centrally imparting a substantially even force to both sides of the pivoting bridge, and substantially equally affecting all the underlying strings. The central location of the engagement point between to engagement points with the bridge, maintains a substantially aligned pivot of the bridge, with its resting axis, during a pivot under force from the arm. This equal communication of force on both sides of the bridge maintains the axis of the pivoting bridge substantially aligned with its axis when at rest. This solves the problem noted which is caused by conventional off-center engagements of the communication of force from the tremolo arm, with the bridge toward and away from the string instrument body for a tremolo effect.

With respect to the above description, before explaining at least one preferred embodiment of the herein disclosed mount for a Tremolo bar to a string bridge, it is to be understood that the invention is not limited in its application to the details of construction and to the arrangement of the components in the following description or illustrated in the drawings. The device herein described and disclosed in the various modes and combinations is also capable of other embodiments and of being practiced and carried out in various ways which will be obvious to those skilled in the art. Any such alternative configuration as would occur to those skilled in the art is considered within the scope of this patent. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other centrally located Tremolo bar attachment points to a bridge, and for carrying out the several purposes of the present disclosed device. It is important, therefore, that the claims be regarded as including such equivalent construction and methodology insofar as they do not depart from the spirit and scope of the present invention.

BRIEF DESCRIPTION OF DRAWING FIGURES

The accompanying drawings, which are incorporated herein and form a part of the specification, illustrate some, but not the only nor exclusive examples of embodiments and/or components of the disclosed device. It is intended that the embodiments and figures disclosed herein are to be considered illustrative of the invention herein, rather than limiting in any fashion. In the drawings.

DETAILED DESCRIPTION OF THE INVENTION

Figure 1:
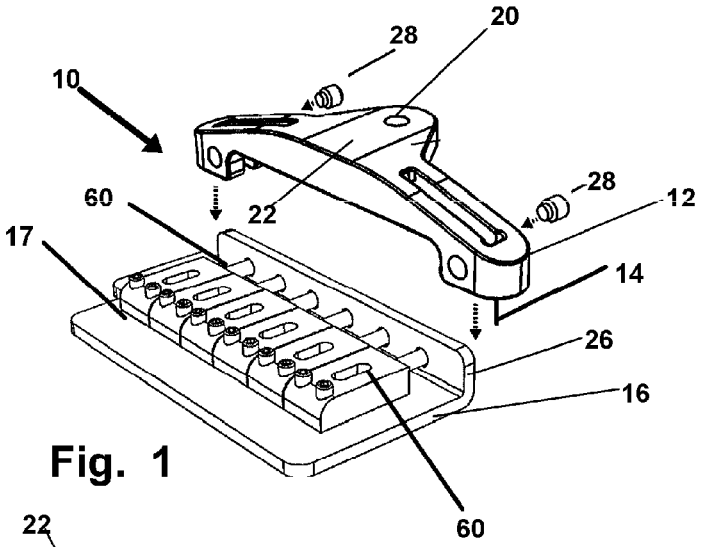
FIG. 1 depicts one mode of the disclosed device showing the body configured on a first side, which is mated to the bridge or bridge plate, with opposing slots in two opposing shoulders of the body for a complimentary engagement with a projections extending from a bridge.
Figure 2:
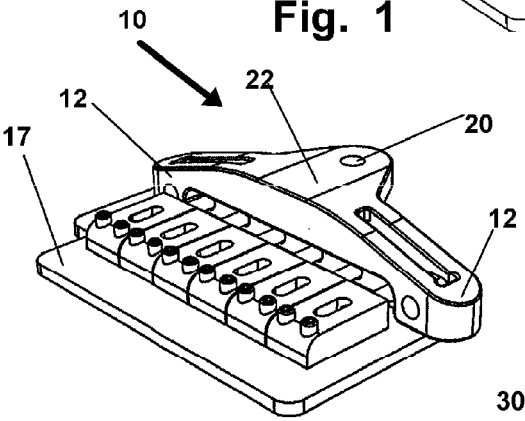
FIG. 2 is a view of the device of FIG. 1 in an as-used position engaged with a guitar bridge with a Tremolo arm attachment point centered relative to the width of a pathway for the strings extending from string mounts on the bridge.

Now referring to drawings in FIGS. 1-11, wherein similar components of the device 10 and method herein, are identified by like reference numerals.

As can be seen FIGS. 1-4, one favored mode of the disclosed device 10 herein is shown having a body 12 configured on a first side 14, for an engagement of the first side 14 with the bridge 16 employed in a tensioning of the strings of the guitar or stringed instrument opposite the neck engagement thereof. The bridge 16 supported by a base plate 17 which is adapted to pivot in its engagement with a guitar body as depicted in the prior art FIG. 6.

In all modes of the device 10 wherever engaged to the underlying bridge 16 or bridge plate 17, it is preferred that attachment point 20 for the engagement end of the tremolo bar, be in a central area above or adjacent the pathway formed by the plurality of strings extending from the bridge 16 toward the neck, and centrally located between attachment points of the body 12 so as to center the force imparted by the engaged tremolo arm, and maintain the bridge 16 centered on its axis during pivoting.

Figure 3:
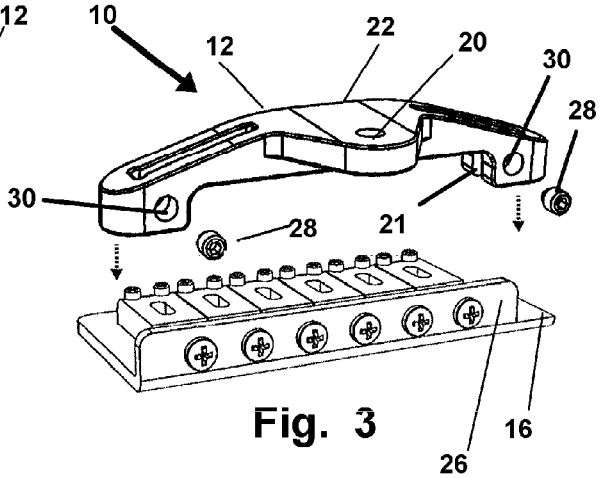
FIG. 3 depicts an opposite side perspective view of the device of FIG. 1.

As best seen in FIG. 1, the body 12 configured on a first side 14 which is mated to the bridge 16 or bridge plate 17, with opposing slots 21 on both ends of the body 12 in two opposing shoulders of the body 12 for a complimentary engagement of the slots 21 with both ends of a projection 26 extending from a bridge 16. As seen in FIG. 3, set screws 28 or other means for engagement may be configured to engage in passages 30 and to be tightened against the projection 26 to hold the body 12 in the as-used position on the bridge 16.

Figure 4:
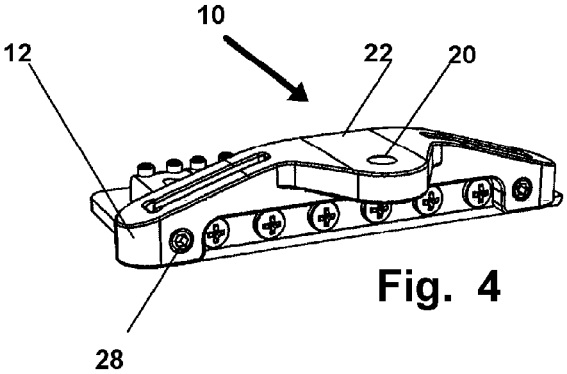
FIG. 4 shows the device of FIG. 2 in the as-used position from an opposite side and showing set screws providing means for removable engagement of the body to the bridge.

As shown in FIG. 4, the attachment point 20 for the tremolo bar, is centrally located relative to the width of the pathway of the plurality of strings which are engageable to the bridge mounts such as with screws 32 and extend traverse to an imaginary line running through the string mounts on the bridge.

Figure 5:
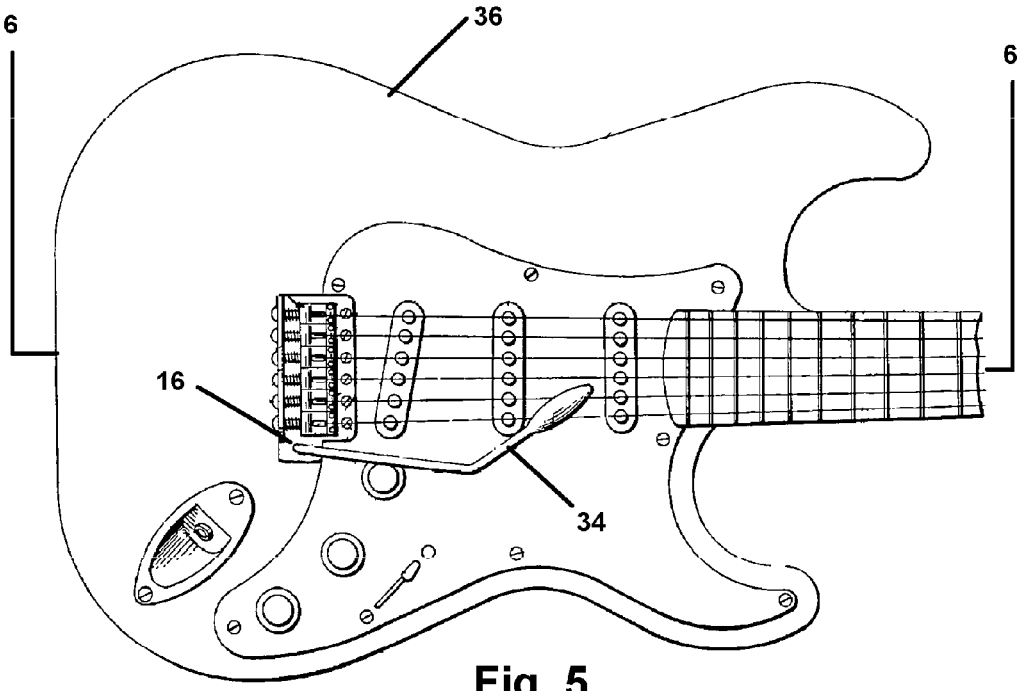
Fig. 5 (Prior Art)
FIG. 5 depicts a prior art showing a conventional prior art bar-style tremolo, engaged in a threaded rotational mount, on one end of a bridge or bridge plate which has a pathway formed between the outside strings of the plurality of strings extending from the bridge, to provide force to pivot the bridge in its engagement with the guitar.
Figure 6:
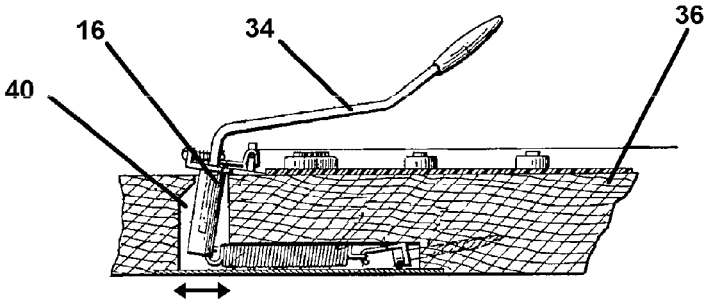
Fig. 6 (Prior Art)
FIG. 6 shows a sectional view through guitar body of FIG. 5 along line 6-6 showing a cavity occupied by a tail section of the bridge, which provides a space for the bridge to pivot therein from force communicated from an engaged tremolo bar.

As noted FIGS. 5-6 are renderings of prior art which is typical of the engagement of a tremolo arm 34 to a bridge 16 wherein the bridge 16 is engaged to the guitar body 36 in a pivoting attachment and extends into a cavity 40 allowing such a pivot. However in conventional art, with the tremolo arm 34 engaged to one side edge of the bridge 16, the force exerted to the bridge 16 tends to pivot the bridge 16 an angle, rather than along the axis or imaginary line running through the bridge 16 and parallel to a line running through contact points with the bridge for all the strings 44.

Figure 7:
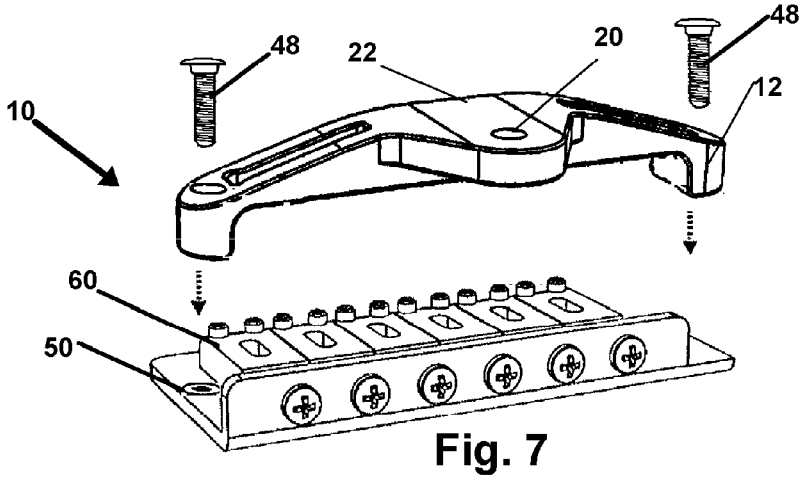
FIG. 7 depicts another mode of the device herein in a employing cooperative fasteners in the form of screws and threaded cavities, to engage two ends of the body to the base plate of the bridge.
Figure 8:
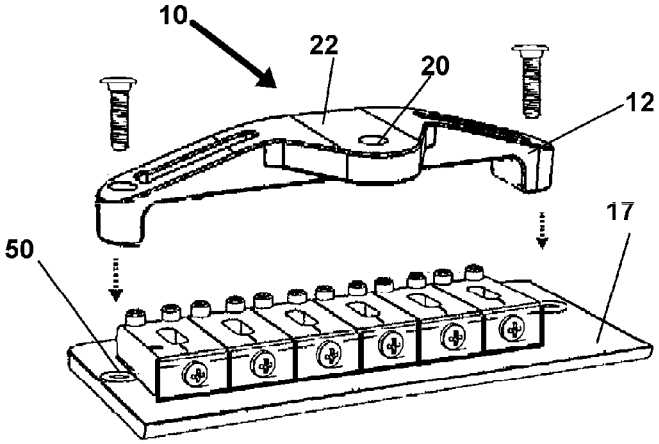
FIG. 8 shows another mode of the device adapted for engagement using fasteners engaged with the base plate of the bridge.

FIG. 7 depicts another mode of the device 10 herein for positioning the connection point 20 for the tremolo arm 34 centrally located adjacent or elevated above the width of the pathway for the strings 44 extending from the bridge 16. In this mode cooperative fasteners in the form of screws 48 engage threaded cavities 50, depending into the body 12 to engage the first side 14 of the body 12 at two ends of the body 12 to the base plate 17 of a bridge 16. A recess 54 formed between two ends of the body 12 is sized to space the body from any contact with the strings 44 or string mounts 60 on the bridge 16 for the strings 44. This mode of the device 10 will engage with a bridge such as that of FIGS. 1-4 having a projection 26 or as depicted FIG. 8, with a bridge 16 which has no such projection 26 in front of the string connectors 60 engaged to the bridge 16.

Figure 9:
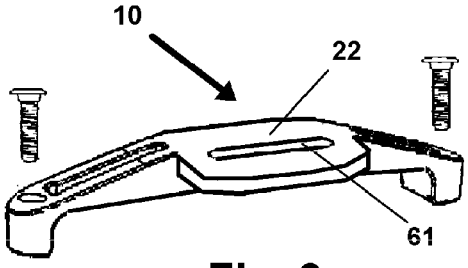
FIG. 9 is a perspective view of a mode of the device having an adjustable attachment point for the proximal end of the Tremolo arm along a distance in the central area of the body.

FIG. 9 is a perspective view of a mode of the device 10 which may include slots 21 (FIG. 3) or a mating of the first side 14 to a bridge 16 for a stringed instrument such as a guitar 36. In this mode of the device 10, an adjustable attachment point 20 is provided wherein the user may adjust position the engagement to the tremolo arm 34 anywhere along the elongated aperture 61 running on both sides of a central portion 22 of the body 12 of the device 10. This allows the user to move the engagement for comfort or sound or other reasons if necessary.

It should be noted, any of the different configurations and components for operative engagement of the device 10 to the bridge 16 of a stringed instrument such as a guitar can be employed, with any other configuration or component shown and described herein, to configure the device 10 for the operative engagement to a stringed instrument. Alternate means for engagement of the body 12 to a bridge 16 as would occur to those skilled in the art, to place a mounting point 20 for the tremolo arm 34, centered adjacent or above the width of the pathway formed by the plurality of strings 44 extending away from the bridge 16, are considered within the scope of this application.

Figure 10:
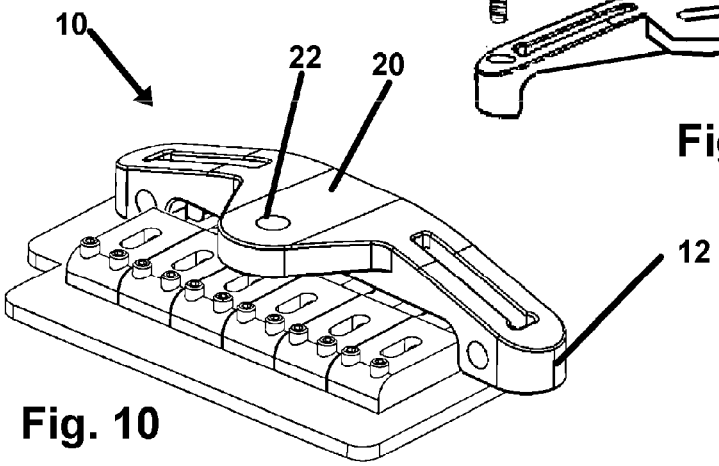
FIG. 10 depicts a perspective view of the device showing that the attachment point may be positioned on a projection from a central portion toward or away from the neck of the guitar.

As shown in FIG. 10, the device 10 the mounting point 20 projecting from the central portion 22 may project toward the rear of the guitar body, or toward the neck, and function equally well.

Figure 11:
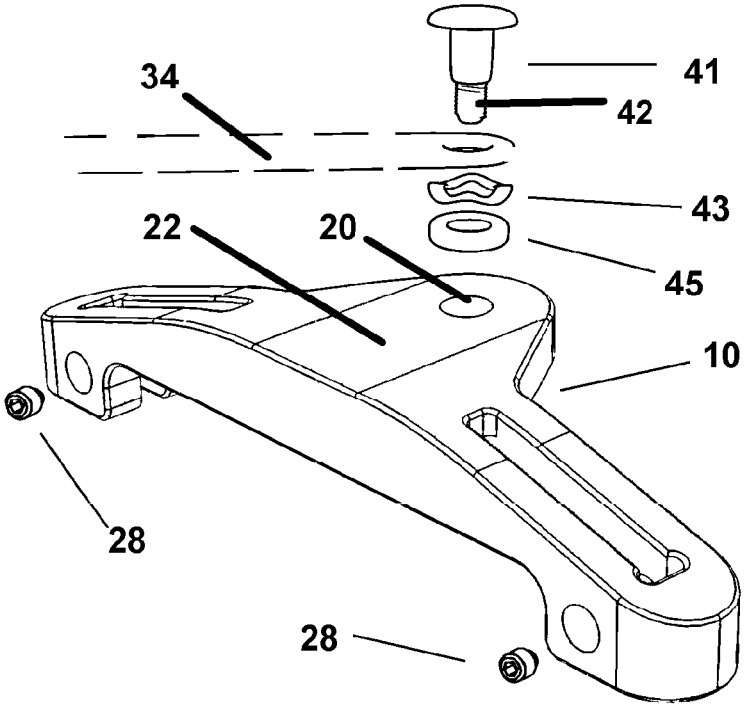
FIG. 11 depicts the device in another preferred mode provided as a kit with attachment components to both the bridge and a tremolo arm.

In another preferred mode of the device 10 shown in FIG. 11, it may be provided as a kit and include means for removable engagement with both a bridge, and to a tremolo arm 34. Provided in combination with the device 10 would be set screws 28 as removable means for engagement to a bridge of a guitar. Also provided preferably is a shoulder bolt 41 configured at a first end for rotational engagement with the aperture of a tremolo arm 34. Securement to the device 10 would be accomplished using a threaded engagement of the distal end 42 of the shoulder bolt 41 with threads at the mounting point 20 or a nut (not shown) on an opposite side thereof. Particularly preferred in order to provide a means to prevent rotation of the tremolo arm 34 unless urged by the user's hand, is the inclusion of a wave washer 43 which when compressed between the tremolo arm 34 and the device 10 or a nylon or polymeric washer 45, provides a biased force against the tremolo arm 34 to maintain the rotational position thereof until urged by the force of the user's hand one direction or the other in a rotational engagement with the shoulder bolt 41.

Additionally, while the present invention has been described herein with reference to particular embodiments thereof a latitude of modifications, various changes and substitutions are intended in the foregoing disclosures, it will be appreciated that in some instance some components, or configurations, or steps in formation and/or use of the invention could be employed without a corresponding use of other components without departing from the scope of the invention as set forth in the following claims. All such changes, alternations and modifications as would occur to those skilled in the art are considered to be within the scope of this invention as broadly defined in the appended claims.

Further, the purpose of any abstract of this specification is to enable the U.S. Patent and Trademark Office, the public generally, and especially the scientists, engineers, and practitioners in the art who are not familiar with patent or legal terms or phraseology, to determine quickly from a cursory inspection the nature and essence of the technical disclosure of the application. Any such abstract is neither intended to define the invention of the application, which is measured by the claims, nor is it intended to be limiting, as to the scope of the invention in any way.

What is claimed is:

1. A tremolo arm mount engageable with a pivoting bridge of a stringed instrument having a having a plurality of string mounts located thereon said tremolo arm mount comprising:

a body, said body having a first end and a second end and having a first side, configured for an engagement with a bridge plate of said bridge which is engaged to said plurality of string mounts;

a pair of slots descending into said first side of said body at respective opposing ends of said body;

each of said slots sized to slide over a projection rising from said bridge plate of said bridge;

a pair of apertures communicating through said body with said slots, said apertures configured for operative engagement of a member engaged therethrough to a contact with said prosection, to maintain said body in an as-used position, actuatable to pivot said bridge plate, and having a central portion of said body extending between said first end and said second end, elevated above said string mounts; and said central portion having an attachment point thereon, said attachment point configured for operative engagement with one end of a tremolo arm, whereby a force communicated from a said tremolo arm engaged with said attachment point, to induce a pivoting of said bridge plate, is communicated to said bridge plate from said attachment point.

2. The mount of claim 1 additionally comprising:

said attachment point adapted for operative engagement a first end of a bolt; and said bolt configured for communication through said one end of said tremolo arm to form a rotational engagement therewith.

3. The mount of claim 1 additionally comprising:

a recess formed into said body on said first side between said first end and said second end of said body; and said recess descending into said body from said first side, a distance equal to or further than a projection distance of said string mounts above a base plate of said bridge.

4. The mount of claim 3 additionally comprising:

said attachment point being an aperture communicating into said central portion of said body.

5. The mount of claim 4 additionally comprising:

said aperture communicating into said central portion of said body from a projection, said projection extending from said central portion of said body along a line traverse to an imaginary line running between said first end and said second end of said body.

6. The mount of claim 1 additionally comprising:

said attachment point being an aperture communicating into said central portion of said body.

7. The mount of claim 6 additionally comprising:

said aperture communicating into said central portion of said body formed as an elongated slot.

8. The mount of claim 6 additionally comprising:

said aperture communicating into said central portion of said body from a projection, said projection extending from said central portion of said body along a line traverse to an imaginary line running between said first end and said second end of said body.

9. The mount of claim 6 additionally comprising:

said attachment point adapted for operative engagement a first end of a bolt; and said bolt configured for communication through said one end of said tremolo arm to form a rotational engagement therewith.

10. The mount of claim 9 additionally comprising:

said aperture communicating into said central portion of said body from a projection extending from said body, said projection extending from said central portion of said body along a line traverse to an imaginary line running between said first end and said second end of said body.

* * * * *